US009207609B2

(12) United States Patent
Granby et al.

(10) Patent No.: US 9,207,609 B2
(45) Date of Patent: Dec. 8, 2015

(54) PRINT BOOST

(71) Applicant: Xerox Corporation, Norwalk, CT (US)

(72) Inventors: Peter Granby, Stevenage (GB); Stephen Foster, Barkway (GB); Wayne Rudge, Reading (GB); Richard Bradford, Hitchin (GB); John Kerslake, Stevenage (GB); Christopher D. Olliffe, Berkhamsted (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/093,742

(22) Filed: Dec. 2, 2013

(65) Prior Publication Data

US 2015/0153695 A1 Jun. 4, 2015

(51) Int. Cl.
*G03G 15/00* (2006.01)

(52) U.S. Cl.
CPC ..... *G03G 15/5016* (2013.01)

(58) Field of Classification Search
CPC ..... H04N 1/00915; G03G 15/50; G03G 15/5012; G03G 15/5016
USPC ..... 399/82, 87
See application file for complete search history.

(56) References Cited

U.S. PATENT DOCUMENTS 6,271,927 B1 * 8/2001 Kohtani et al. ..... 358/1.16
2010/0027052 A1 * 2/2010 Ferlitsch ..... 358/1.15

* cited by examiner

*Primary Examiner* — David Bolduc
*Assistant Examiner* — Barnabas Fekete
(74) *Attorney, Agent, or Firm* — Fay Sharpe LLP

(57) ABSTRACT

A method of printing is provided comprising: assigning a first set of image performance parameters from a plurality of image performance parameters to an associated image job; communicating the initially assigned first set of image performance parameters of the associated image job to an image marking engine; determining a queue of other image jobs assigned to the image marking engine, wherein the other image jobs are queued before the associated image job; and, assigning a second set of image performance parameters to the associated image job. The second set of image performance parameters can alter the first set of image performance parameters. The altering of the first set of image performance parameters to the second set of image performance parameters reduces a print duration to complete printing of the associated image job. The altering can further include reordering the queue of print jobs.

13 Claims, 2 Drawing Sheets

PRINT BOOST

BACKGROUND

In a xerographic printing system many times jobs are needed earlier or sooner than the designated order of the print queue (i.e., by first order received). In some situations a user of a printing system or image marking engine would like to have a print job reordered and/or altered in such a manner that the assigned or associated image job is printed sooner and/or faster than the initial designation. The altering of a print job may be such that a second set of print parameters is different than, or changes, an initial set of print parameters. This disclosure is directed to a method and system for altering or changing the print parameters and/or modifying the order of a print queue to expedite a particular assigned print job.

BRIEF DESCRIPTION

A printing system and method is provided comprising: assigning a first set of image performance parameters from a plurality of image performance parameters to an associated image job, wherein the first set of image performance parameters comprises a first image quality. The method further provides for communicating the initially assigned first set of image performance parameters of the associated image job to an image marking engine; determining a queue of other image jobs assigned to said image marking engine, wherein the other image jobs are queued before the associated image job; and, assigning a second set of image performance parameters to the associated image job. The second set of image performance parameters can comprise a second image quality, wherein the second set of image performance parameters can alter the first set of image performance parameters. The altering of the first set of image performance parameters to the second set of image performance parameters reduces a print duration to complete a printing of the associated image job wherein the second image quality is less than the first image quality.

The present disclosure further provides for a method of printing comprising: assigning a first set of image performance parameters from a plurality of image performance parameters to an associated image job, wherein the first set of image performance parameters comprises a first image quality; communicating the initially assigned first set of image performance parameters of the associated image job to an image marking engine; determining a queue of other image jobs assigned to the image marking engine, wherein the other image jobs are queued before the associated image job; and, assigning a second set of image performance parameters to the associated image job. The second set of image performance parameters can comprise a second image quality and the second set of image performance parameters can alter the first set of image performance parameters. The altering of the first set of image performance parameters to the second set of image performance parameters reduces a print duration to complete a printing of the associated image job, wherein the second image quality is less than the first image quality. The altering can be done at a control panel positioned at the image marking engine. The altering can be selected from the group consisting of: degrading finishing, defeating finishing, switching from duplex to simplex, increasing printing speed, converting to draft mode, and bypassing stapling.

Further in accordance with the disclosure, a method of printing is provided comprising: assigning a first set of image performance parameters from a plurality of image performance parameters to an associated image job; communicating the initially assigned first set of image performance parameters of the associated image job to an image marking engine; determining a queue of other image jobs assigned to the image marking engine, wherein the other image jobs are queued before the associated image job; and, assigning a second set of image performance parameters to the associated image job. The second set of image performance parameters can alter the first set of image performance parameters. The altering of the first set of image performance parameters to the second set of image performance parameters reduces a print duration to complete printing of the associated image job. The altering can further include reordering the queue of print jobs.

BRIEF DESCRIPTION OF THE DRAWINGS

The following is a brief description of the drawings used to illustrate the present disclosure, and thus, is being presented for illustrative purposes only and should not be limitative of the scope of the present disclosure, wherein.

DETAILED DESCRIPTION

Figure 1:
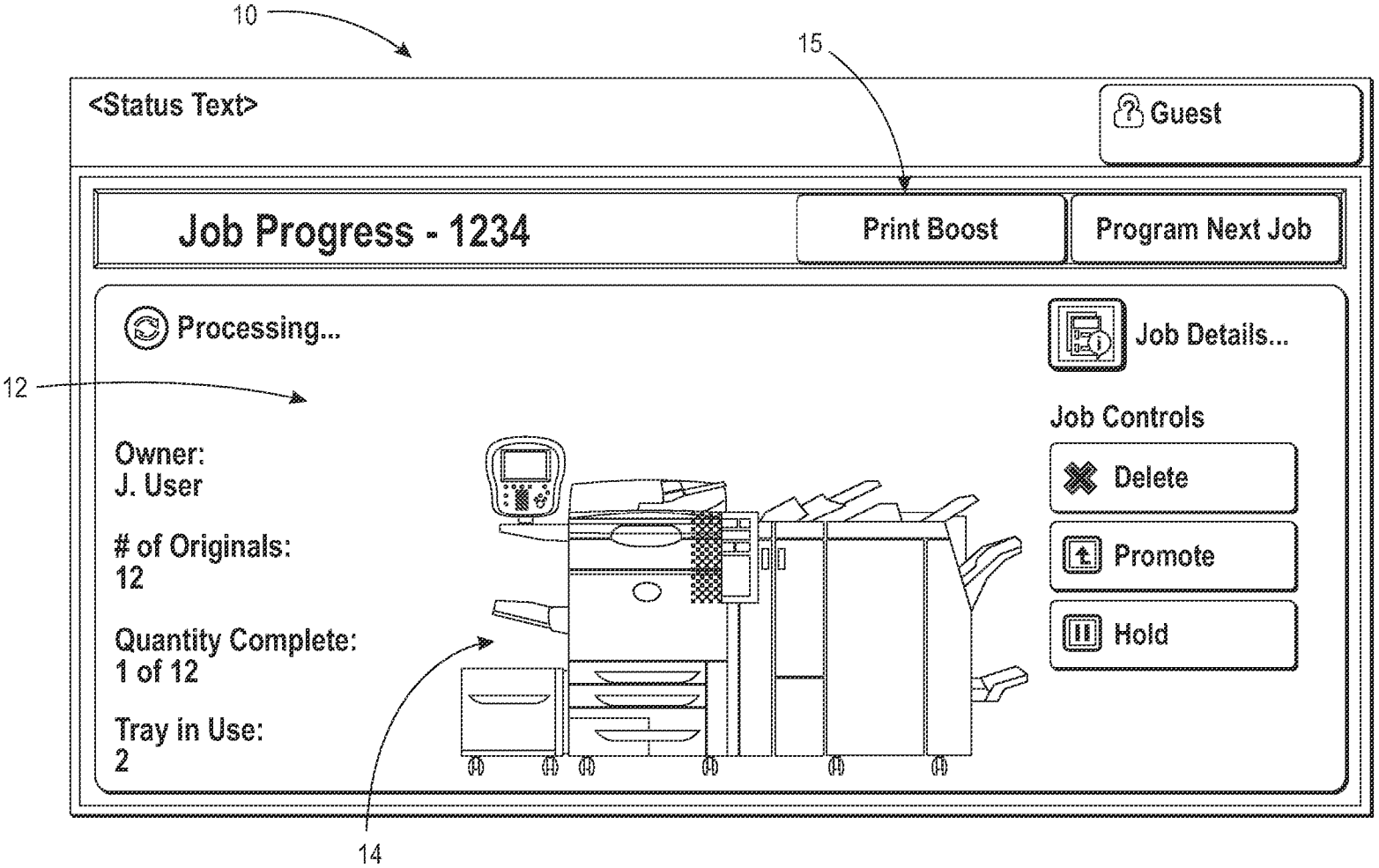
FIG. 1 shows a control screen illustrating an exemplary view of controls for altering a set of image performance parameters; and, FIG. 2 shows an exemplary list of the image performance parameters.

In many areas of copiers/printers/scanner image quality, it is desirable to establish and maintain a certain image quality of output. In this manner, the workflow can be monitored and maintained at a predetermined and assigned image quality level. The workflow can include image jobs that are sent to an image marking engine and aligned or ordered in a specific queue that release and print jobs in a predetermined order. In many situations a first-in-first-out (FIFO) is a typical queue arrangement.

In some situations, a user may want to alter the print parameters and/or alter the ordering of an existing queue in order to expedite or immediately advance an associated print job to be the present or next image job to be processed. The user may have sent a print job to the image marking engine and then proceed to the location of the image marking engine, wherein the user may find that their job is not printing and is somewhere further down in the print queue. The user may have a need for an immediate printing of their print job in order to acquire a hardcopy of the print job from the image marking engine. The user in certain circumstances may not have the option to be able to wait until the print jobs that are queued ahead of their job are printed beforehand. Additionally, the user may not only want to reorder the print queue to reduce the wait time preceding the associated print job, but also alter the print parameters to reduce the amount of actual processing time consumed by their print job.

The present disclosure provides for a print menu option(s) that provides for alternate print performance parameters that alter initial or preset print parameters. The altering of the print parameters provides the user the option of boosting the performance of the image marking engine for their respective print job, i.e., enable the image marking engine to print out a respective print job faster and sooner than initially prescribed and assigned, respectively. The altering of the print job, to be described hereinafter, can be processed in a variety of ways which provides to the user a method for retrieving a hard copy printout of their respective print job sooner than originally assigned.

The user can initially send a print job to the image marking engine and then physically proceed to the image marking engine in order to retrieve their print job. If the user arrives at the image marking engine and finds that their print job is in a queue such that their print job is not presently running, the user can then have the option of altering the print assignments to expedite printing of their job. This may result if, for example, the user is running late for a meeting and/or immediately needs a hardcopy printout for reference and does not have the time to wait for the print queue to reach their print job. The user then is faced with the option of having to wait for the already prescribed print queue and print parameters and thus inconveniencing the user by not being able to immediately retrieve a hardcopy of the printout. This situation can be particularly annoying if the print queue is large, and/or the print jobs ahead of the associated print job are large, and/or if the print jobs ahead of the associated print job have print parameters that require additional print time.

Figure 2:
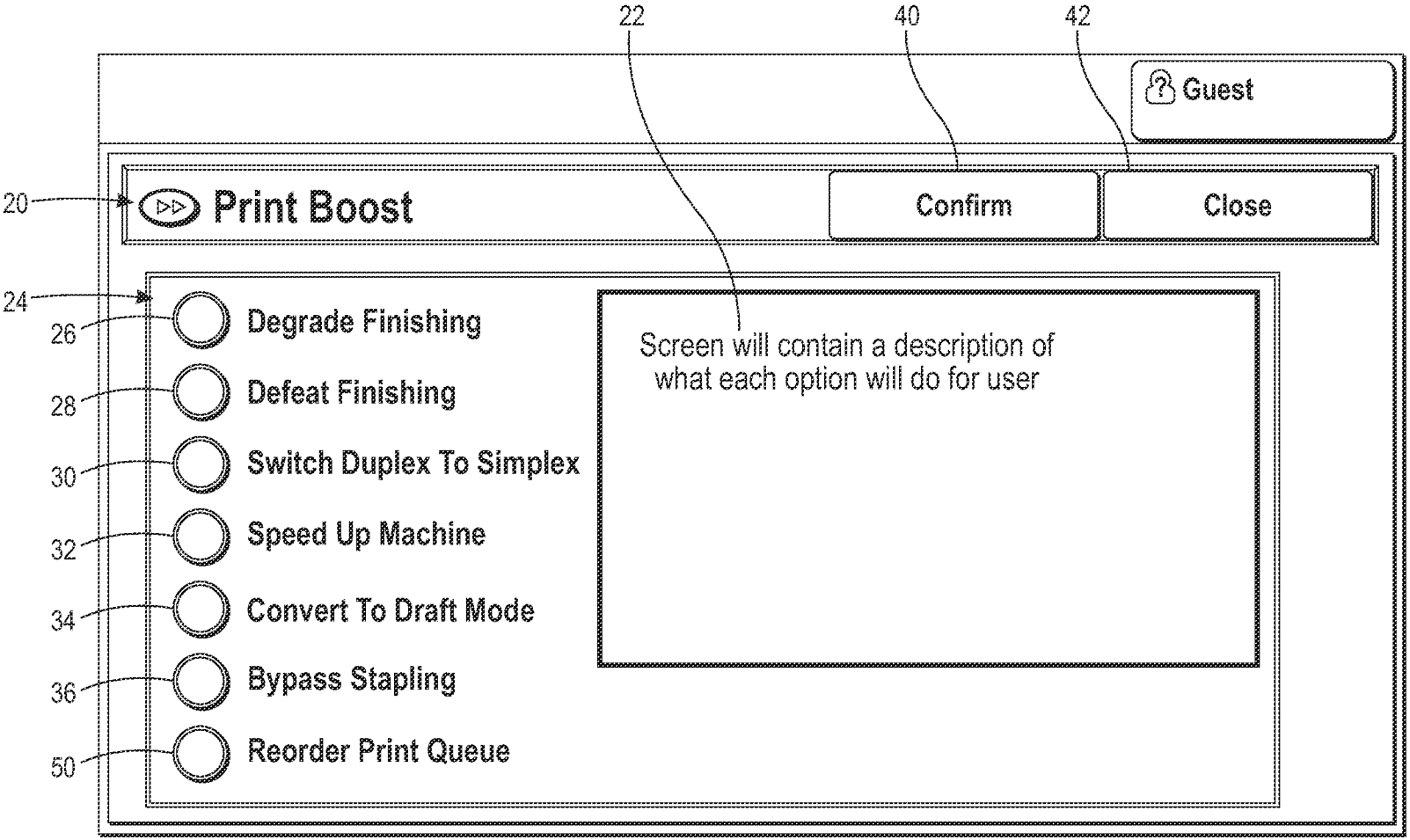

The present disclosure provides for menu options 10 on a job progress window 12 at the image marking engine 14 which can give the user the options for boosting the performance 15 of the image marking engine 14 to expedite the printing of the associated print job (refer to FIG. 1). The selections on the job progress window 12 can provide any number of print parameter alterations, if the user selects the alterations, that will result in the associated print job being processed quicker and/or initiated sooner. FIG. 2 illustrates an exemplary print boost button 20 on the job progress screen 22. Some of the exemplary print boost options 24 or image performance parameters that can comprise the print boost feature 20 include: degrading the finisher selections on the job 26 (changing dual front corner stitch to single front corner stitch); defeating all finishing 28; switching from duplex to simplex 30; increasing printing speed 32; converting to draft modes 34; and, bypassing stapling 36.

Additional and other options, not listed above, can be incorporated in the list of potential image performance parameters 24. As listed above, one option can include configuring the image marking engine 14 such that the print boost feature 20 runs the associated image job at a faster rated speed 32 than is normally set. Most image marking engines are built so that they can run at different speeds within a product range, wherein one variable includes the finisher attached to some image marking engines such that some finishers only run at certain speeds. The actual speeding up of the image marking engine 14 could selectively be done on a single job only basis and would thus degrade the print quality of the associated image job to enable the user to retrieve the hardcopy of the associated image job quicker.

Referring to FIG. 2, some of the applicable image performance parameter options 24 can be displayed on a pop-up screen 22 to be viewed by the user for selection and confirmation 40 of what options the user desires to select. Depending on what parameters are selected, the image marking engine 14 will then apply them to the associated image job such that the parameter options are applied to all, or a selected portion of, sheets of the associated image job. The screen 22 on the image marking engine 14 can display the selected parameter options for the user's confirmation 40 review, and closing 42.

In addition to, or alternatively, the user can reorder the presently assigned print queue 50. For example, the user can stop the present printing of another print job, and immediately proceed to printing of their associated image job. Alternatively, the user can allow the existing or the present print job to complete printing and then reorder the print queue such that their associated image job is the next image job to be processed. It is to be appreciated, that the assigning of the image performance parameters 24 can be done remotely at a workstation separate from the image marking engine. It is to be appreciated that the altering of the image performance parameters 24 and/or the reordering of the print queue 50 can be done either remotely or at the control panel of the image marking engine.

One exemplary method of printing can comprise the following. A user can assign a first set of image performance parameters from a plurality of image performance parameters to an associated image job. The first set of image performance parameters can comprise a preset or first prescribed image quality. The user communicates the initially assigned first set of image performance parameters of the associated image job to an image marking engine. The processor, as part of the image marking engine, determines a queue of all image jobs assigned to the image marking engine. Typically the assignment of the queue is established as a FIFO queue. This queue assignment generally involves processing the image jobs in the order that they are received at the image marking engine. The user, upon realizing that their associated image job is needed immediately or before the print queue can be depleted, can assign a second set of image performance parameters to the associated image job. The second set of image performance parameters can comprise a second image quality. The second set of image performance parameters can alter the first set of image performance parameters. The altering of the first set of image performance parameters to the second set of image performance parameters reduces a print duration to complete printing of the associated image job. The second image quality can be less than the first image quality to accommodate the reduction in print duration. The assigning of the first set of image performance parameters can be done remotely from the image marking engine. The altering of the image performance parameters can be done remotely from the image marking engine or can be done at the control panel positioned at the image marking engine. The altering of the image performance parameters can be selected from the group consisting of: degrading finishing 26, defeating finishing 28, switching from duplex to simplex 30, increasing printing speed 32, converting to draft mode 34, and bypassing stapling 36. The altering of the print assignment can further include reordering the queue 50 of other image jobs and the associated image job. In one exemplary alteration, the reordering can include immediately stopping printing of a current image job and starting the associated image job. In another exemplary arrangement, the reordering can include finishing printing of the current image job and then moving the associated image job to the next image job in the queue of other image jobs.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A method of printing, comprising:

assigning a first set of image performance parameters from a plurality of image performance parameters to an associated image job;

said first set of image performance parameters comprises a first image quality;

communicating said initially assigned said first set of image performance parameters of said associated image job to an image marking engine;

determining a queue of other image jobs assigned to said image marking engine;

wherein said other image jobs are queued before said associated image job;

assigning a second set of image performance parameters to a selected portion of said associated image job;

said second set of image performance parameters comprises a second image quality;

said second set of image performance parameters alter said first set of image performance parameters;

said altering of said first set of image performance parameters to said second set of image performance parameters reduces a print duration to complete printing of said associated image job;

wherein said second image quality is less than said first image quality;

wherein said altering further includes reordering said queue of other image jobs and said associated image job; and, wherein said reordering includes immediately stopping printing of a current image job and starting said associated image job.

2. The method of claim 1, wherein said assigning said first set of image performance parameters is done remotely from said image marking engine.

3. The method of claim 1, wherein said altering is done remotely from said image marking engine.

4. The method of claim 1, wherein said altering is done at a control panel positioned at said image marking engine.

5. The method of claim 4, wherein said altering is selected from the group consisting of: degrading finishing, defeating finishing, switching from duplex to simplex, increasing printing speed, converting to draft mode, and bypassing stapling.

6. A method of printing, comprising:

assigning a first set of image performance parameters from a plurality of image performance parameters to an associated image job;

said first set of image performance parameters comprises a first image quality;

communicating said initially assigned said first set of image performance parameters of said associated image job to an image marking engine;

determining a queue of other image jobs assigned to said image marking engine;

wherein said other image jobs are queued before said associated image job;

assigning a second set of image performance parameters to said associated image job;

said second set of image performance parameters comprises a second image quality;

said second set of image performance parameters alter said first set of image performance parameters;

said altering of said first set of image performance parameters to said second set of image performance parameters reduces a print duration to complete printing of said associated image job;

wherein said second image quality is less than said first image quality;

wherein said altering is done at a control panel positioned at said image marking engine;

wherein said altering is selected from the group consisting of: degrading finishing, defeating finishing, switching from duplex to simplex, increasing printing speed, converting to draft mode, and bypassing stapling;

wherein said altering further includes reordering said queue of other image jobs and said associated image jobs; and, wherein said reordering includes immediately stopping printing of a current image job and starting said associated image job.

7. The method of claim 6, wherein said assigning said first set of image performance parameters is done remotely from said image marking engine.

8. A method of printing, comprising:

assigning a first set of image performance parameters from a plurality of image performance parameters to an associated image job;

communicating said initially assigned said first set of image performance parameters of said associated image job to an image marking engine;

determining a queue of other image jobs assigned to said image marking engine;

wherein said other image jobs are queued before said associated image job;

assigning a second set of image performance parameters to said associated image job;

said second set of image performance parameters alter said first set of image performance parameters;

said altering of said first set of image performance parameters to said second set of image performance parameters reduces a print duration to complete printing of said associated image job;

wherein said altering further includes reordering said queue of print jobs;

wherein said reordering includes selectively immediately stopping printing of a current image job and then starting printing of said associated image job.

9. The method of claim 8, further comprising:

said first set of image performance parameters comprises a first image quality;

said second set of image performance parameters comprises a second image quality; and, wherein said second image quality is less than said first image quality.

10. The method of claim 8, wherein said altering is done remotely from said image marking engine.

11. The method of claim 8, wherein said altering is done at a control panel positioned at said image marking engine.

12. The method of claim 10, wherein said altering is selected from the group consisting of: degrading finishing, defeating finishing, switching from duplex to simplex, increasing printing speed, converting to draft mode, and bypassing stapling.

13. The method of claim 11, wherein said altering is selected from the group consisting of: degrading finishing, defeating finishing, switching from duplex to simplex, increasing printing speed, converting to draft mode, and bypassing stapling.

* * * * *